United States Patent [19]

Stanley et al.

[11] Patent Number: 4,543,493

[45] Date of Patent: Sep. 24, 1985

[54] ELECTRIC CONTROL CIRCUIT

[75] Inventors: William W. Stanley, Batavia; Glenn E. Mikyska, Naperville, both of Ill.

[73] Assignee: Cymatics, Inc., Naperville, Ill.

[21] Appl. No.: 477,764

[22] Filed: Mar. 22, 1983

[51] Int. Cl.[4] ..... H01H 47/32

[52] U.S. Cl. ..... 307/126; 307/140; 307/141; 361/197; 361/205; 200/39 R

[58] Field of Search ..... 307/126, 140, 141, 252 UA; 361/152, 205, 196, 197; 200/34, 39 R

[56] References Cited

U.S. PATENT DOCUMENTS

| | | | |
|---|---|---|---|
| 2,866,862 | 12/1958 | Bachi | 200/34 |
| 3,267,337 | 8/1966 | Doyle et al. | 361/153 |
| 3,345,546 | 10/1967 | Beltramo | 318/132 |
| 3,662,190 | 5/1972 | Naber | 307/252 UA |
| 3,971,969 | 7/1976 | Wines et al. | 361/205 |
| 4,021,626 | 5/1977 | Becker | 200/39 R X |
| 4,270,058 | 5/1981 | Schormack | 307/140 |
| 4,276,486 | 6/1981 | Ahuja et al. | 307/252 UA X |
| 4,370,564 | 1/1983 | Matsushita | 307/140 |
| 4,449,161 | 5/1984 | Kling | 361/152 |

FOREIGN PATENT DOCUMENTS 2057206 3/1981 United Kingdom .

*Primary Examiner*—A. D. Pellinen
*Assistant Examiner*—Derek S. Jennings
*Attorney, Agent, or Firm*—Fitch, Even, Tabin & Flannery

[57] ABSTRACT

Apparatus for switching alternating current from a power source to a load for substantially all of one selected half-cycle, but not before at least one full cycle after the apparatus receives an operator command to switch the current, includes a mechanical switch for commanding the apparatus at an arbitrary time to switch the current. Electrical control devices produce a control output during a portion of the selected half-cycle. A second switch device, such as an SCR, responsive to the control output switches the current to the load during the selected half-cycle. The control output is turned off before the end of the half-cycle and is not produced again until the mechanical switch is released and provides another command to switch the current.

10 Claims, 10 Drawing Figures

FIG.1
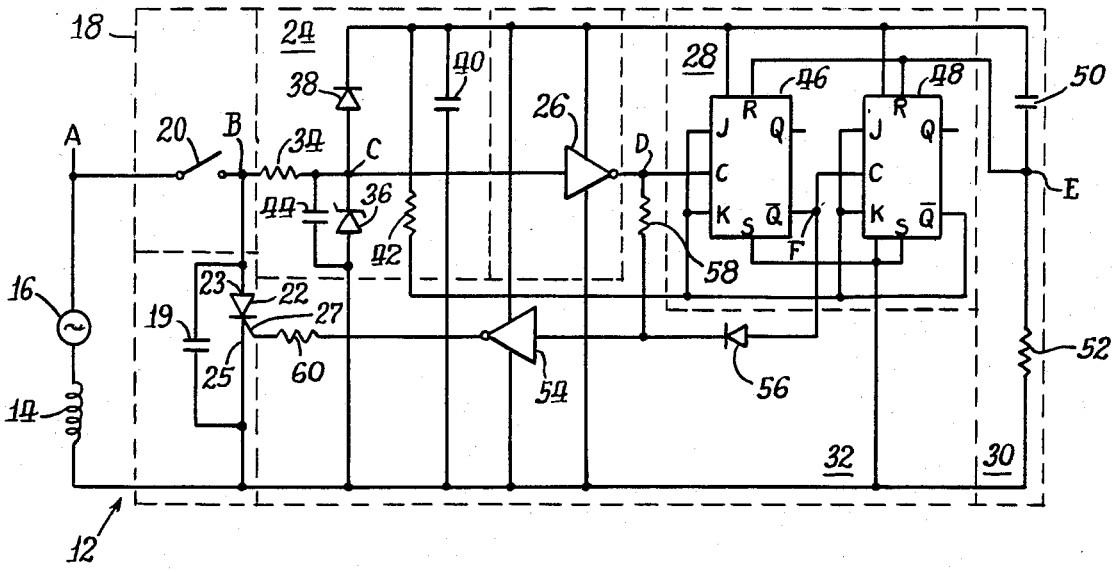
FIG.2F
FIG.2E
FIG.2D
FIG.2C
FIG.2B
FIG.2A
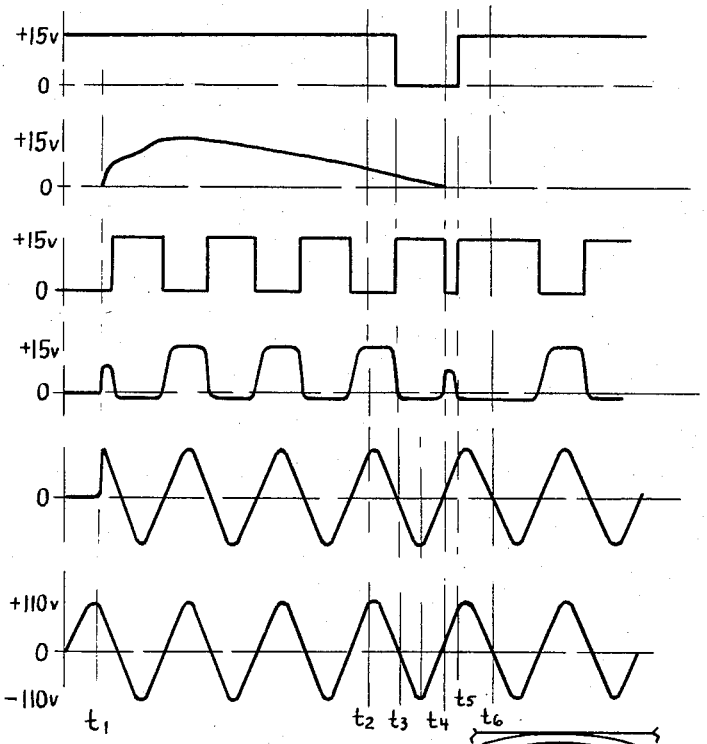
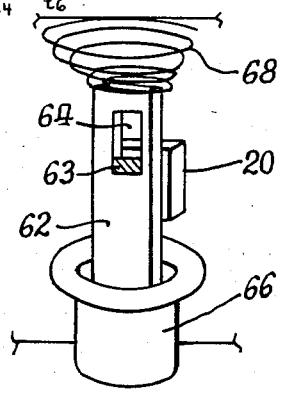
FIG.5

ELECTRIC CONTROL CIRCUIT

BACKGROUND OF THE INVENTION

This invention relates to switching apparatus for alternating current electrical circuits, and more particularly, to control circuits for turning on a solenoid or the like for one half cycle of a predetermined alternating current cycle which occurs at least one full cycle after the circuit receives an operator command to operate the solenoid.

Solenoids for electric staplers and other devices are generally controlled by a mechanical switch which may be actuated by an operator or other machine apparatus. The switch is part of a solenoid control circuit which only permits the solenoid to operate for a predetermined interval of time each time that the mechanical switch is actuated. The solenoid is turned off by the control circuit at the end of the interval, even if the switch is still actuated, and cannot be operated again until the mechanical switch is released and actuated again.

Commercially available solenoids operate through an entire stroke on one full half-cycle of line current, at about 110 volts and 60 Hz. Some known solenoid control circuits include a silicon controlled rectifier (SCR) or other device in series with the power source and solenoid for controlling the solenoid so that current only flows for no longer than one full half cycle. Such circuits generally turn the SCR on immediately upon actuation of an operator controlled mechanical switch. The performance of such circuits is somewhat limited because if the SCR is turned on toward the end of a half-cycle, when the input current is near zero, adequate power may not be provided to the solenoid for proper operation.

Other control circuits delay turning the SCR on after the mechanical switch is actuated until shortly after the current crosses zero and enters the first full positive half-cycle of current immediately following the actuation of the switch. In this manner, the solenoid receives current for substantially all of the half-cycle, regardless of when the mechanical switch is actuated.

The contacts of most mechanical switches have some tendency to bounce when actuated, which may cause improper operation of the solenoid. The zero-crossing circuits just discussed may not eliminate the undesirable effects of contact bounce because the maximum delay is less than a full cycle, and the contacts may bounce after the delay. Thus, there is a need for control circuits for solenoids and the like which provide a delay of at least one full cycle between the time that the mechanical switch is actuated and the time that the SCR turns on the solenoid.

In many previous control circuits, power is permanently connected to the solenoid through the SCR or other switching device without a mechanical switch which physically breaks the power line when the solenoid is not in operation. If the SCR is turned on by transients, the solenoid may operate unexpectedly, and if the SCR shorts, the solenoid may remain on indefinitely. Both of these conditions are undesirable. Thus, there is also a need for a control circuit for the solenoid of electric power staplers and the like which mechanically interrupts the power to the solenoid when the solenoid is not operated.

SUMMARY OF THE INVENTION

Accordingly, an object of this invention is to provide new and improved switching apparatus for alternating current electrical circuits.

Another object is to provide new and improved control circuits for the solenoid of an electric stapler or the like.

Still another object is to provide circuits for operating such a solenoid or other load in response to the actuation of a mechanical switch for substantially all of one selected half-cycle of an alternating current cycle which occurs at least one full cycle after the mechanical switch in the circuit is actuated.

In keeping with one aspect of this invention, apparatus is provided for switching alternating current from a power source to a load for substantially all of one selected half-cycle which occurs at least one full cycle after the apparatus receives an operator command to switch the current. The apparatus is particularly useful for operating a solenoid in an electric stapler or the like. Mechanical switching means is provided for commanding the apparatus to switch the current. Delay means responsive to the mechanical switching means produces a first output for a predetermined time interval which occurs at least one full cycle after the command. The half-cycle selected for operation of the solenoid occurs during a portion of the time interval in which the delay means produces the first output. Zero sensing means produces a second output during the time interval of the first output, shortly after the power cycle passes zero potential and begins the selected half-cycle, and gate means responsive to the first and second outputs produces a control output during a portion of the selected half-cycle. Second switching means, such as an SCR, is provided which is responsive to the control output. The second switching means switches the current to the load during the selected half-cycle, turning the solenoid on. The control output is turned off before the end of the half-cycle, and will not be produced again until the mechanical switching means is released and provides another command to operate the solenoid.

In one embodiment, the mechanical switching means is connected in series with the power source and the load so that power is mechanically interrupted between operator commands when the solenoid is not operating. Mechanical means is provided in that embodiment for keeping electrical contacts in the mechanical switching means closed through the selected half-cycle to prevent a loss of power which would occur if the contacts were opened during operation of the solenoid. In an alternate embodiment, the mechanical switching means is connected to the delay means in such a manner that the solenoid does not operate if the mechanical switching means is actuated when power is initially applied to the switching apparatus and load.

BRIEF DESCRIPTION OF THE DRAWINGS

The above-mentioned and other features of this invention and the manner of obtaining them will become more apparent, and the invention itself will be best understood by reference to the following description of the invention taken in conjunction with the accompanying drawings in which:

FIG. 1 is a schematic diagram of one embodiment of the switching apparatus of this invention;

FIGS. 2A–2F are a series of waveforms at selected reference points in the switching apparatus of FIG. 1;

FIG. 5 is a perspective view of a switch actuator which may be used with the switching apparatus of FIG. 1.

DESCRIPTION OF THE PREFERRED EMBODIMENTS

Figure 3:
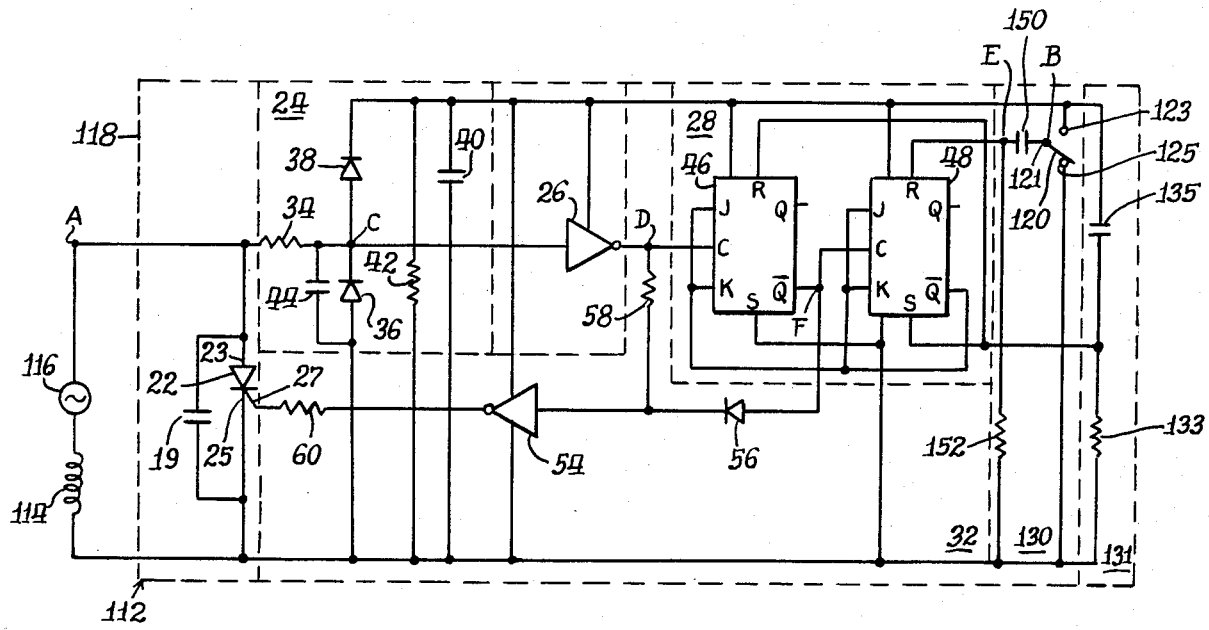
FIG. 3 is a schematic diagram of an alternate embodiment of the switching apparatus of FIG. 1.
Figure 4:
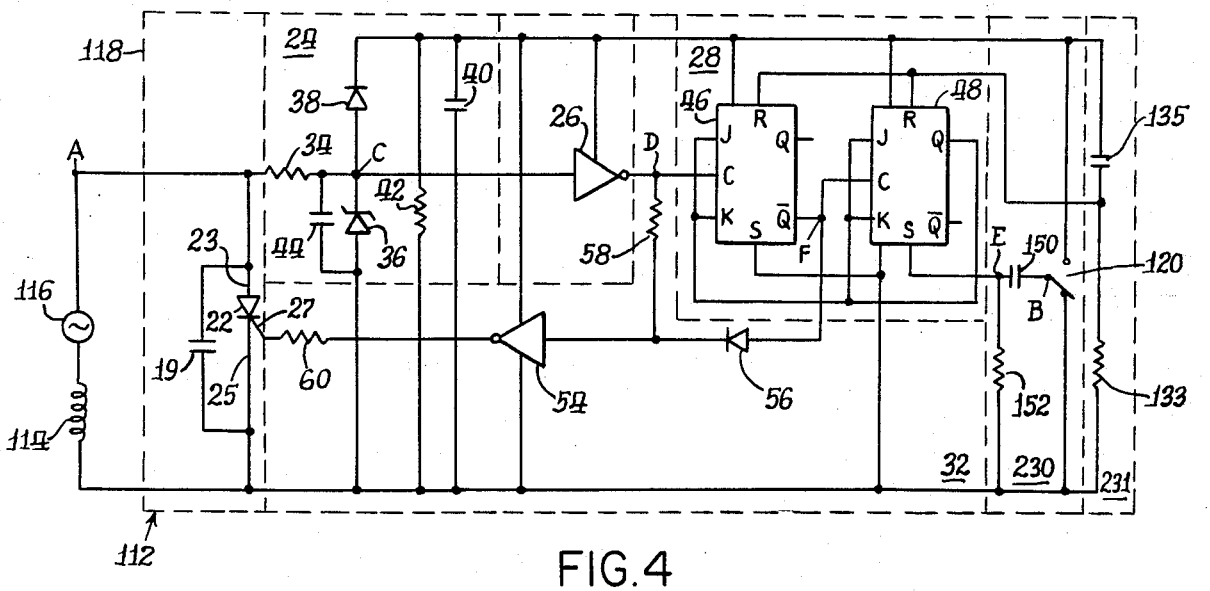
FIG. 4 is a schematic diagram of another alternate embodiment of the switching apparatus of FIG. 1.

FIGS. 1, 3 and 4 show three embodiments of this invention, all of which provide a delay of at least one full alternating current cycle between actuation of a mechanical switch and application of power to a solenoid. In all embodiments, an alternating current power source, a solenoid, and an SCR switching device are connected in series with each other. In FIG. 1, however, the mechanical control switch is also connected in series with the other devices, so that power to the solenoid is mechanically interrupted when the switch is open. This approach prevents undesired operation of the solenoid which may be caused by transients, SCR failure or the like.

In FIGS. 3 and 4, the mechanical switching device is not connected in series with the solenoid, SCR and power source. The embodiments of FIGS. 3 and 4 prevent operation of the solenoid if the mechanical switching device is actuated when the power source is initially turned on or connected. Thus, the embodiments of FIGS. 1, 3 and 4 all provide the desired delay, but have different features which may be useful in particular applications.

The apparatus 12 shown schematically in FIG. 1 includes a solenoid 14 or other intermittently operated load, an alternating current power source 16 connected in series with the solenoid 14, and a switching apparatus 18 connected in series with the solenoid 14 and the power source 16.

The switching apparatus 18 includes a mechanical switching means 20 which is connected in series with the power source 16 and the solenoid 14, and an SCR or other electronic switching device 22 which is connected in series with the solenoid 14, power source 16 and switch 20 as shown. A capacitor 19 is provided across an anode 23 and cathode 25 of the SCR 22 for SCR transient protection. Thus, when the switch 20 contacts are open, power is mechanically interrupted. When the contacts are closed and the SCR 22 is turned on, current flows in series from the power source 16, through the switch 20 and SCR 22, to the solenoid 14.

Delay means is provided in the switching apparatus 18 for producing an output to a gate 27 of the SCR 22 a predetermined time after the switch 20 contacts are closed. The delay means includes a rectifier circuit 24, a wave shaping device 26, a counter circuit 28, a delay circuit 30, and a gate circuit 32. The delay means provides an output to the gate 27 of the SCR 22 at the beginning of a predetermined half-cycle of the power source 16.

The power source 16 may be line current or the like which provides power at about 110 volts, and 60 Hz. The solenoid 14 may require about a 60 ampere surge for ½ cycle each time the switch 20 is actuated by an operator. The switching apparatus 18 shown in FIG. 1 permits the contacts of the switch 20 to fully close before the current surge passes through the switch by not turning the SCR 22 on until at least one full cycle after the contacts are closed. If the current surge began when the switch 20 contacts initially closed, problems associated with contact bounce might be encountered, and a switch rated at about 60 amperes would be required. By delaying the surge until the contacts are completely closed, the possibility of undesired contact bounce is reduced, and a slide switch or the like rated at about 2 amperes may be used. Such switches are generally smaller and less expensive than switches rated at 60 amperes. Thus, in this embodiment, the delay means reduces problems associated with contact bounce, and permits the use of a much smaller, lower current switch because the current surge does not occur until the switch 20 contacts are fully closed.

The rectifier means 24 includes a resistor 34, a Zener diode 36, a capacitor 44, a diode 38, a filter capacitor 40, and a bleeder resistor 42. The bleeder resistor 42 only discharges the capacitor 40 after the operation cycle of the switching apparatus is completed, as will be seen. The capacitor 44 is provided as shown to maintain the output of the rectifier 24 at an acceptable level until the SCR 22 turns on.

The unfiltered voltage over the Zener diode 36, which approximates a square wave, is shaped by the wave shaping circuit 26, which may be a Schmitt trigger device such as a Motorola MC 14584B Schmitt trigger or the like. The circuit 26 increases both the rise and the fall times of the voltage waveform over that of the diode 36 waveform, and produces a second output shortly after the power cycle passes zero potential during each cycle. In commercially available devices, the second output may be produced at about 5 volts.

The counting means 28 includes a first binary counter 46 and a second binary counter 48 which is cascaded with the first counter 46. Counters 46, 48 may be a Motorola MC 14027B dual flip-flop array or the like. The reset terminals of the counters 46, 48 are connected as shown to the delay circuit 30, which includes a capacitor 50 in series with a resistor 52.

The gate circuit 32 includes an inverter 54, a diode 56, and resistors 58 and 60. The inverter 54 provides a control output to the gate 27 of the SCR 22 through the resistor 60 when both the output of the wave shaping ciruit 26 and the $\overline{Q}$ output of the counter 46 are low. A NAND gate or other suitable configuration could be used for the gate circuit 32, if desired.

The operation of the switching apparatus 18 may be better understood with reference to the letter designations of FIG. 1, and the corresponding waveforms shown in FIGS. 2A–2F. The output of the power source 16 is shown in FIG. 2A, and the closing of the switch 20 at an arbitrary time $t_1$ is shown in FIG. 2B. The output of the diode 36 is shown in FIG. 2C, and the output of the wave shaping circuit 26 is shown in FIG. 2D. The voltage over the resistor 52, which provides the reset voltage for the counters 46, 48, is shown in FIG. 2E, and the $\overline{Q}$ output of the counter 46 is shown in FIG. 2F.

When the switch 20 is initially closed, at time $t_1$, (FIG. 2B), the SCR 22 is off. The output of the diode 38 sets the inverter 54 output low. As the capacitor 50 begins charging, the voltage over the resistor 52 (FIG. 2E) maintains the counters 46, 48 in a reset condition, forcing the $\overline{Q}$ output of the counter 46 high until the voltage over the resistor 52 drops below the threshold level of the counters, at time $t_2$ in FIG. 2E. The threshold should be crossed between about two and four cycles after the time $t_1$. The delay may be varied by changing the values of the capacitor 50 and the resistor 52.

Both J-K inputs of the counters 46, 48 are connected to the $\overline{Q}$ output of the counter 48, so that all of the inputs are high through the time $t_2$. The clock pulse (FIG. 2D) immediately following time $t_2$, which occurs at time $t_3$, changes the $\overline{Q}$ output of the counter 46 to the low state, as seen in FIG. 2F. At time $t_4$, the output of the wave shaping circuit 26 goes low, the control output of the inverter 54 goes high, and the SCR 22 turns on. The SCR 22 effectively shorts the input to the rectifier 22, but the capacitor 44 maintains the high state on the input of the wave shaping circuit 26 until the SCR 22 is turned on fully. When the capacitor 44 discharges, which may occur at about time $t_5$, the output of the wave shaping circuit goes high, which toggles the counter 46, forcing the $\overline{Q}$ output high, at time $t_5$. The rising $\overline{Q}$ pulse from the counter 46 clocks the counter 48. Since the $\overline{Q}$ output of the counter 48 is tied to the inputs of both counters, the counters are locked and prevent the $\overline{Q}$ output of counter 46 from going low again until the switch 20 is released and actuated another time.

The SCR 22 is turned on during the time interval between times $t_4$ and $t_6$, which is substantially an entire half-cycle. In this manner, the SCR is turned on for substantially all of a selected half-cycle which occurs at least one full cycle after the operator actuates the switch 20.

One terminal of the bleeder resistor 42 is connected to the $\overline{Q}$ output of the counter 48. Since the $\overline{Q}$ output is normally high, the capacitor 40 is not discharged until the end of the cycle. This feature increases the charging rate of the power supply, and better maintains the voltage over the capacitor 44 and the capacitor 40 when the SCR 22 turns on. Since the SCR 22 effectively removes power from the power supply 24 when it turns on, maintaining the output of the power supply 24 while the SCR is on is important to insure that the counting means 28 operates through its entire cycle.

Since the contacts of the switch 20 must be closed when the SCR 22 is turned on, it is preferable to provide means for keeping the contacts of the switch 20 closed for at least about four cycles after the switch 20 is actuated, even if the operator releases the switch before that time. This may be accomplished in many ways, including that shown in FIG. 5. The switch 20 is a slide switch or the like having a knob 63 which may be actuated by a plate 62 having a slot orifice 64, and a push-button control 66. In FIG. 5, the switch 20 is shown actuated, and the switch contacts are closed. When the button 66 is released, the switch 20 contacts will not open until the open part of the orifice 64 slides past the knob 63 and opens the switch 20 contacts. A spring 68 may be provided which pushes the plate 62 down at a rate which assures the passage of about four or more cycles before the switch 20 contacts are opened.

The embodiment of FIG. 3 is similar to that of FIG. 1. Apparatus 112 includes a power supply 116 connected in series with a solenoid 114 and a switching apparatus 118. The switching apparatus 118 is similar to the apparatus 18 in FIG. 1, but a switch 120 having a common contact 121, a normally open contact 123, and a normally closed contact 125 is provided in a delay circuit 130, and a second delay circuit 131 having a resistor 133 and a capacitor 135 is provided as shown. The voltage over the resistor 133 is provided to the SET terminal of the counter 48.

The power supply 24 is on continuously while the power supply 116 is connected. When the power source 116 is initially connected, the voltage over the resistor 133 provides a RESET input to the counter 46, and a SET input to the counter 48 for a predetermined time. This operation prevents the $\overline{Q}$ output of the counter 48 from responding to a RESET signal until the voltage over the resistor 133 decreases below the level required to maintain the SET state, even if the switch 120 is actuated when the power source 116 is initially connected. The second delay circuit 131 maintains the counters in the SET state, as if the SCR 22 had just been turned on, so the SCR will not turn on until the switch 120 is released and actuated again. This prevents accidents which might be caused if the switch 120 were actuated when power was initially applied. The resistor 133 and capacitor 135 are chosen so that the SET condition is maintained longer than the RESET condition.

The embodiment of FIG. 4 is similar to the embodiment of FIG. 3, and includes a delay circuit 230 and a second delay circuit 231 connected as shown. The second delay circuit 231 prevents the SCR from turning on if the switch 120 is actuated when power is initially applied, by maintaining the $\overline{Q}$ output of the counter 46 in the RESET condition for a predetermined period of time which is longer than the time during which the delay circuit 230 produces a SET condition.

The operation of the embodiment of FIG. 3 is similar to that of FIG. 1. Before the switch 120 is actuated, contacts 121 and 125 are connected, and the capacitor 150 is not charged. When the switch 120 is actuated, contacts 121 and 123 are connected, and the delay circuit 130 begins the counter circuit cycle previously described. The operation of the embodiment of FIG. 4 is similar to that of FIG. 3, except that the switch 120 is connected to the SET terminal of the counter 48 through the capacitor 150, and the J-K inputs of the counter 48 are connected to the Q output of the counter 48. When the switch 120 is actuated, the Q output of the counter 48 is held high until the voltage over resistor 152 drops below the threshold level of the SET input and permits the counting cycle previously described to begin.

The many advantages of this invention are now apparent. A delay is provided so that the SCR does not turn the solenoid on until at least one cycle has passed after the mechanical switch is actuated. If the mechanical switch is in series with the power source, solenoid and SCR, power is applied to the SCR only when the mechanical switch is actuated. This prevents damage due to transient operation and failure of the SCR, and permits the use of a relatively low current switch. The mechanical switch may also be placed elsewhere in the switching apparatus to insure that the SCR does not turn on if the mechanical switch is actuated when power is initially applied to the apparatus. In all embodiments, problems associated with contact bounce are reduced because of the delay.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. Apparatus for switching alternating current from a power source to a load, comprising:

mechanical switching means for commanding said apparatus at an arbitrary time to switch said current;

control means, responsive to said mechanical switching means, for generating a control output during a portion of a selected half-cycle of alternating current, said control output being delayed for at least one full cycle of alternating current after said command to switch current and not recurring until said switching means is released and then re-actuated;

said control means having counter means including a first J-K bistable device and a second J-K bistable device, the J-K inputs of said first and second bistable devices being connected to a first output of said second bistable device such that if said second bistable device is in one state then both bistable devices are enabled to change state upon the application of a clock signal to their respective clock inputs and such so that if said second bistable device is in another state then both bistable devices are locked in their respective states until said second bistable is reset, said first bistable device connected to the clock input of said second device by an output such that a transition from one state to another state by said first device will apply a clock signal to said second device; delay means for generating a reset signal applied to said first and second bistable devices for a predetermined period of time longer than one full cycle of alternating current and applied in response to said command to switch current; half wave rectifying means for rectifying a portion of said alternating current; wave shaping means for decreasing the rise and fall times of said rectifying means output; said first bistable device receiving a clock pulses from the output of said wave shaping means whereby said first bistable device generates a first output if said delay time has elapsed;

gate means, responsive to said first output and the output of said wave shaping means, for generating said control output during a portion of said selected half cycle of alternating current; and second switching means, responsive to said control output, for switching current to said load during said selected half cycle.

2. Apparatus according to claim 1 wherein said gate means comprises an inverter responsive to both said first output and said second output, the output of said inverter being said control output.

3. Apparatus according to claim 1 wherein said gate means comprises a NAND gate responsive to said first output and said second output, the output of said NAND gate being said control output.

4. Apparatus according to claim 1 wherein said second switching means comprises a silicon controlled rectifier.

5. Apparatus according to claim 1 wherein said mechanical switching means comprises a mechanical switch having contacts which interrupt the alternating current path of said control means and said second switching means when said contacts are open, and completes both current paths when said contacts are closed.

6. Apparatus according to claim 5 wherein said mechanical switching means comprises mechanical means for keeping said switch contacts closed for at least about four cycles after said contacts are closed.

7. Apparatus according to claim 6 wherein said mechanical switching means comprises a slide switch having an actuator knob, and said mechanical means comprises a movable plate having an orifice through which said knob extends, said contacts being closed by moving said plate in a predetermined direction, and a spring for opening said contacts by moving said plate in a second predetermined direction such that said orifice passes over said knob before said contacts are opened, said spring moving said plate at a rate which assures that at least about four cycles pass before said contacts open.

8. Apparatus according to claim 1 wherein said mechanical switching means comprises a mechanical switch having contacts which disable said control means when open and enable said control means when closed, without interrupting the current path of said second switching means or said control means, said control means comprising means connected to said control means for disabling said control means and said second switching means if said mechanical switch commands said apparatus to switch said current when current is initally provided to said apparatus.

9. Apparatus for switching alternating current from a power source to a load for substantially all of one selected half-cycle which occurs at least one full cycle after said apparatus receives an operator command to switch said current comprising:

mechanical switching means for commanding said apparatus to switch said current;

control means responsive to said mechanical switching means for producing a control output during a portion of said selected half-cycle; and second switching means responsive to said control output for switching said current to said load during said selected half-cycle, wherein said mechanical switching means comprises a mechanical switch having contacts which interrupt the alternating current path of said control means and said second switching means when said contacts are open, and completes both current paths when said contacts are closed, wherein said mechanical switching means comprises mechanical means for keeping said switch contacts closed for at least about four cycles after said contacts are closed; and wherein said mechanical switching means comprises a slide switch having an actuator knob, and said mechanical means comprises a movable plate having an orifice through which said knob extends, said contacts being closed by moving said plate in a predetermined direction, and a spring for opening said contacts by moving said plate in a second predetermined direction such that said orifice passes over said knob before said contacts are opened, said spring moving said plate at a rate which assures that at least about four cycles pass before said contacts open.

10. Apparatus for switching alternating current from a power source to a load for substantially all of one selected half-cycle which occurs at least one full cycle after said apparatus receives an operator command to switch said current comprising:

mechanical switching means for commanding said apparatus to switch said current;

control means responsive to said mechanical switching means for producing a control output during a portion of said selected half-cycle; and second switching means responsive to said control output for switching said current to said load during said selected half-cycle, wherein said mechanical switching means comprises a mechanical switch having contacts which disable said control means when open and enable said control means when closed, without interrupting the current path of said second switching means of said control means, said control means comprising means connected to said control means for disabling said control means and said second switching means if said mechanical switch commands said apparatus to switch said current when current is initially provided to said apparatus.

* * * * *